US012590453B2

(12) United States Patent
Brekke et al.

(10) Patent No.: US 12,590,453 B2
(45) Date of Patent: Mar. 31, 2026

(54) CONCEALED STRUCTURAL CONNECTOR

(71) Applicant: Columbia Insurance Company, Omaha, NE (US)

(72) Inventors: Steven Brekke, Lakeville, MN (US); Trent Kortenbusch, St. Paul, MN (US)

(73) Assignee: Columbia Insurance Company, Omaha, NE (US)

( * ) Notice: Subject to any disclaimer, the term of this patent is extended or adjusted under 35 U.S.C. 154(b) by 484 days.

(21) Appl. No.: 18/054,937

(22) Filed: Nov. 14, 2022

(65) Prior Publication Data

US 2023/0067333 A1 Mar. 2, 2023

Related U.S. Application Data

(63) Continuation of application No. 16/866,146, filed on May 4, 2020, now Pat. No. 11,525,255.

(51) Int. Cl.
*E04B 1/26* (2006.01)

(52) U.S. Cl.
CPC .... *E04B 1/2604* (2013.01); *E04B 2001/2648* (2013.01); *E04B 2001/2652* (2013.01); *E04B 2001/268* (2013.01)

(58) Field of Classification Search
CPC ..... E04B 1/2604; E04B 2001/2648; E04B 2001/2652; E04B 2001/268; E04B 1/2612
See application file for complete search history.

(56) References Cited

U.S. PATENT DOCUMENTS

| | | | | |
|---|---|---|---|---|
| 4,299,509 | A | 11/1981 | Meickl | |
| 4,398,841 | A | 8/1983 | Kojima et al. | |
| 4,558,968 | A | 12/1985 | Meickl | |
| 5,022,209 | A * | 6/1991 | Kimura | E04B 1/26 52/646 |
| 5,438,811 | A | 8/1995 | Goya | |
| 5,598,680 | A | 2/1997 | Wilhelmi | |

(Continued)

FOREIGN PATENT DOCUMENTS

| | | |
|---|---|---|
| CA | 2131107 C | 9/1995 |
| CH | 636395 A5 | 5/1983 |

(Continued)

OTHER PUBLICATIONS

International Search Report and Written Opinion received from counterpart PCT/US2021/030417, dated Aug. 24, 2021, 13 pp.

(Continued)

*Primary Examiner* — Patrick J Maestri
(74) *Attorney, Agent, or Firm* — Stinson LLP

(57) ABSTRACT

A concealed connector for connecting a first structural component to a second structural component includes a connection portion and a connection plate. The connection portion attaches to the second structural component. The connection plate attaches to the first structural component. The connection plate is coupled to the connection portion and extends into a slot in the first structural component. The connection plate has a perforated region that is penetrated by at least one fastener to attach the connection plate to the first structural component. The perforated region is deformed by the at least one fastener to permit the at least one fastener to penetrate the perforated region of the connection plate.

20 Claims, 11 Drawing Sheets

(56) References Cited

U.S. PATENT DOCUMENTS

| | | | | |
|---|---|---|---|---|
| 5,617,694 | A | 4/1997 | Baba | |
| 5,620,275 | A * | 4/1997 | Novacek | F16B 9/058 403/403 |
| 6,032,431 | A | 3/2000 | Sugiyama | |
| 6,669,396 | B2 | 12/2003 | Mattle | |
| 8,511,033 | B2 | 8/2013 | Kumakawa et al. | |
| 9,920,531 | B1 | 3/2018 | Charest et al. | |
| 10,422,123 | B2 | 9/2019 | Holland | |
| 2002/0025217 | A1 * | 2/2002 | Mattle | F16B 25/10 403/294 |
| 2007/0186503 | A1 | 8/2007 | Homma et al. | |
| 2013/0028657 | A1 | 1/2013 | Kenho | |
| 2018/0127971 | A1 | 5/2018 | Holland | |
| 2019/0048574 | A1 | 2/2019 | Ernst | |

FOREIGN PATENT DOCUMENTS

| | | | |
|---|---|---|---|
| DE | 2914716 | A1 | 10/1980 |
| EP | 0130145 | A1 | 1/1985 |
| EP | 2292856 | A2 | 3/2011 |
| WO | 2013157168 | A1 | 10/2013 |
| WO | 2014121948 | A1 | 8/2014 |
| WO | 2018130551 | A1 | 7/2018 |

OTHER PUBLICATIONS

Extended European Search Report, European Application No. 21800817, dated May 7, 2024, 8 pages.

* cited by examiner

CONCEALED STRUCTURAL CONNECTOR

STATEMENT OF RELATED CASES

This application is a continuation of U.S. Ser. No. 16/866,146, filed May 4, 2020, the entire contents of which are incorporated herein by reference.

FIELD

The present disclosure generally relates to structural connectors, and more specifically to concealed structural connectors.

BACKGROUND

The use of connectors, such as hangers, to attach a first structural component (e.g., joists, beams, etc.) to a second structural component (e.g., headers, beams, columns, etc.) is commonplace. Such connectors use fasteners (e.g., bolts, nails, screws, pins, etc.) to connect the structural components. Concealed connectors are a type these of connectors that are generally hidden from view once connected to the structural components. One type of concealed connector includes a plate (e.g., knife plate) that extends into a slot formed in the first structural component. The plate may include openings that align with corresponding openings in the first structural component so that dowels or pins can be inserted therethrough to connect the plate to the first structural component. This requires an operator to use a jig to properly form openings in the first structural component that align with the openings in the plate, a time intensive process. In other variations, the plate may not have pre-formed openings but be made out of a softer material (e.g., aluminum or an aluminum alloy) that can be easily penetrated by the fastener (e.g., screw). This allows the plate to be connected to the first structural component without first using a jig, saving time, but the strength or load bearing capacity of the concealed connector is reduced. Moreover, if the wood is treated with materials including copper, it can react with aluminum and seriously degrade its structural integrity.

SUMMARY

In one aspect of the present invention, a concealed connector for connecting a first structural component to a second structural component generally comprises a connection portion configured to attach to the second structural component. A connection plate configured to attach to the first structural component is attached to the connection portion and configured to extend into a slot in the first structural component. The connection plate has a perforated region having pre-formed openings therein. The openings located in at least a subregion of the perforated region are configured in relation to the size of a fastener of a plurality of fasteners to be used to make a connection between the first and second structural components so that the fastener passing through any location within the subregion of the perforated region engages and deforms the connection plate to attach the connection plate to the first structural component.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
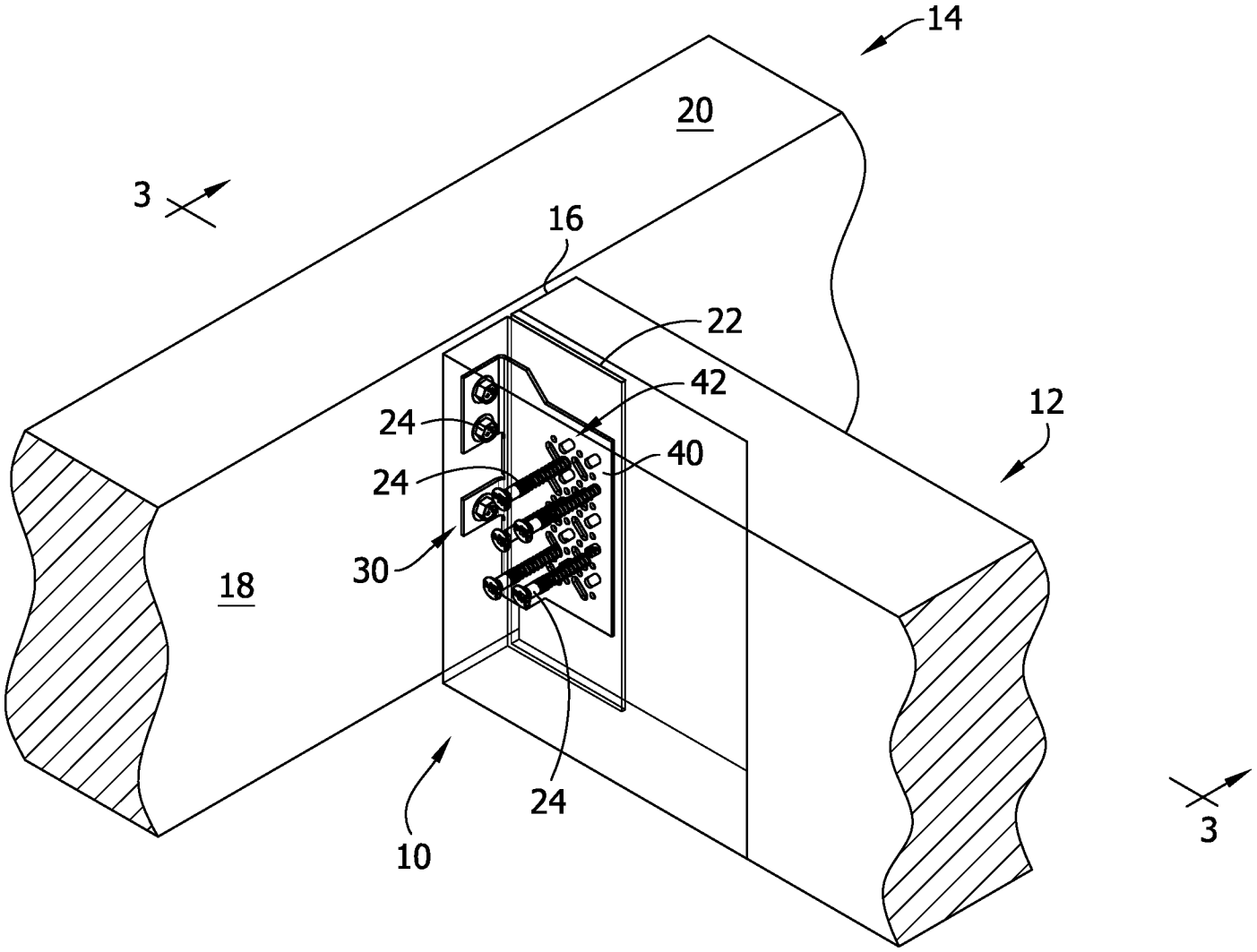
FIG. 1 is a perspective of a concealed connector according to one embodiment of the present disclosure connecting a joist to a header, a portion of the first structural component is transparent to show interior details.
Figure 2:
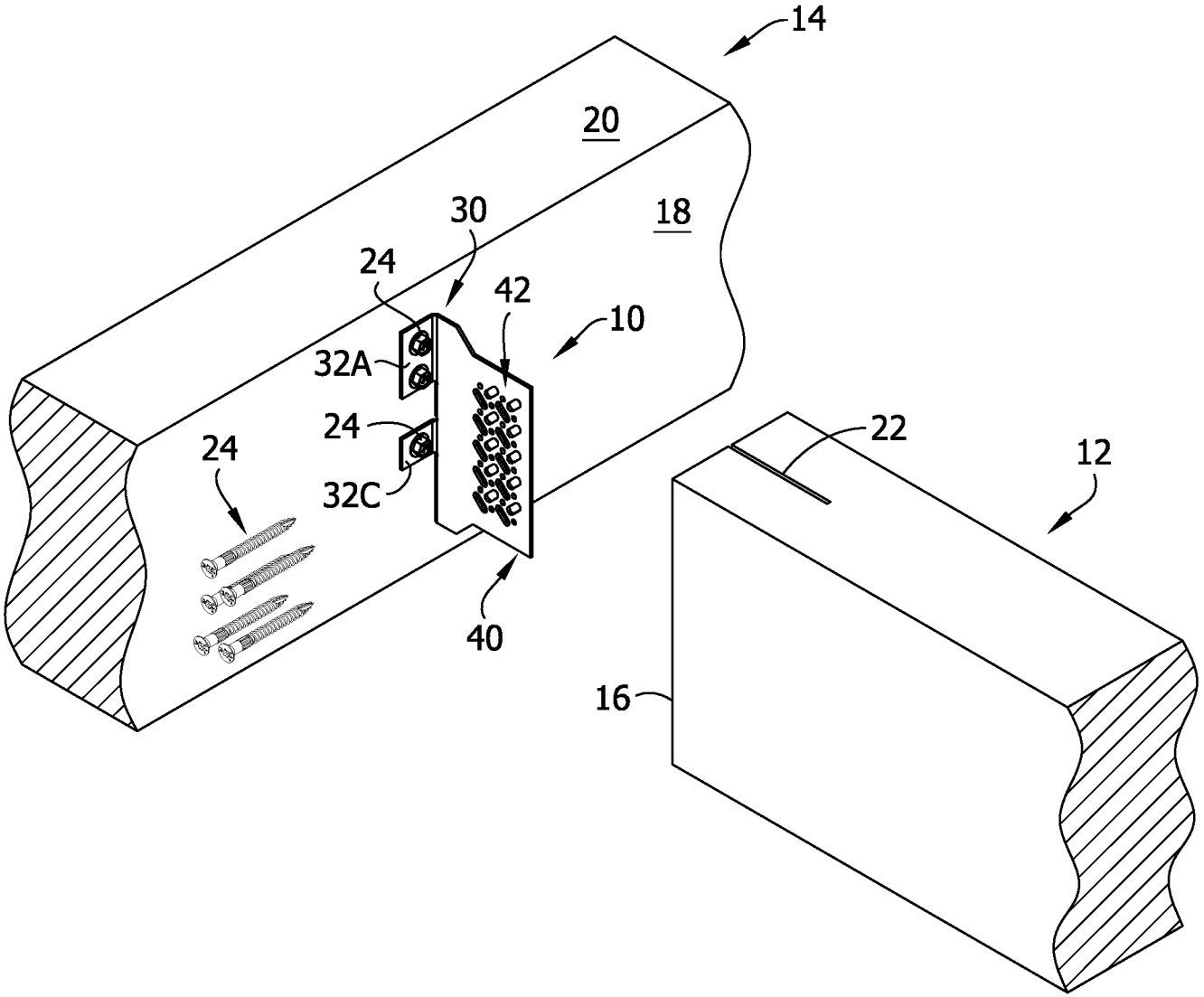
FIG. 2 is an exploded view of FIG. 1.
Figure 3:
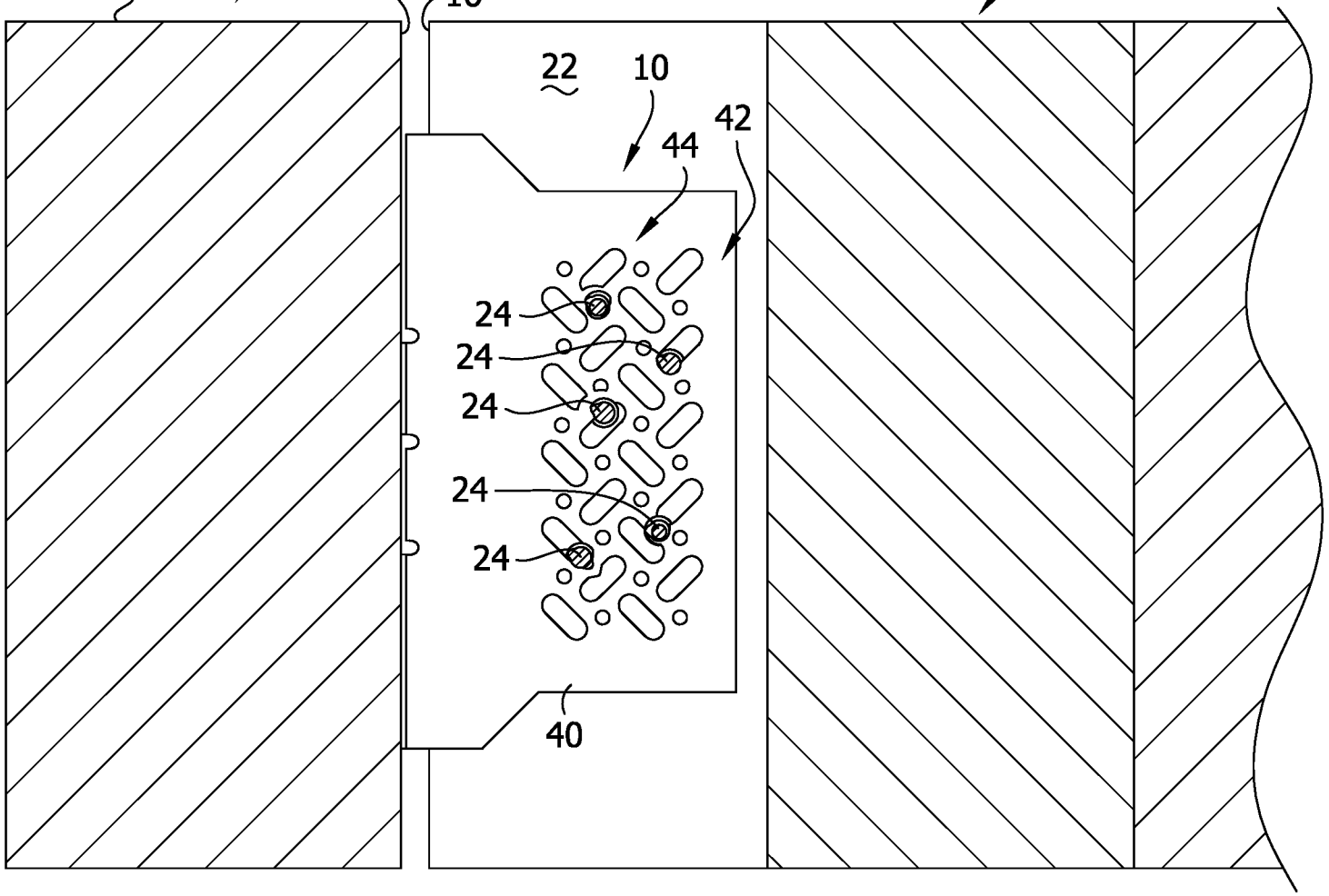
FIG. 3 is a section of the concealed connector connecting the first structural component to the second structural component taken through line 3-3 of FIG. 1.
Figure 4:
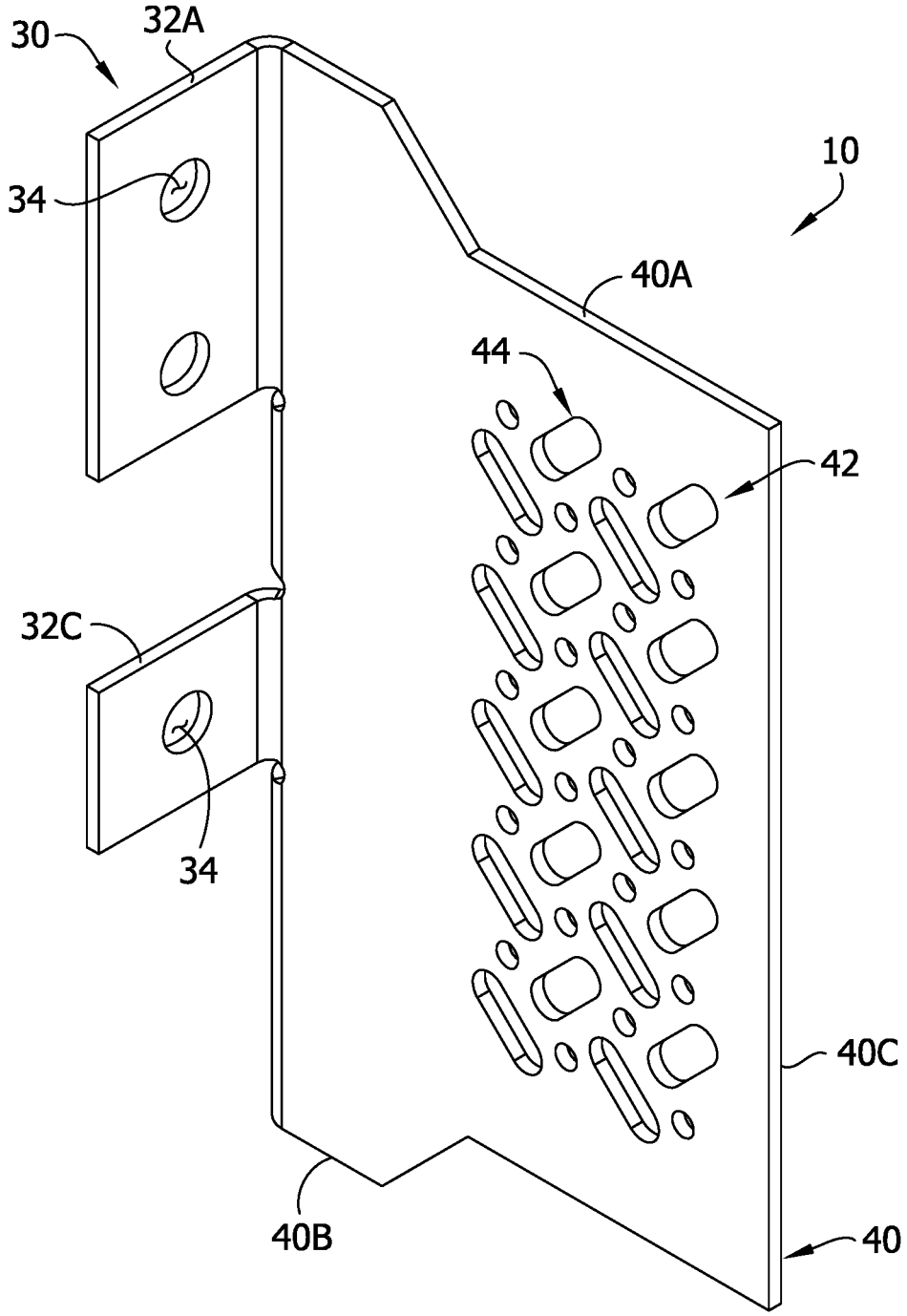
FIG. 4 is a front perspective of the concealed connector of FIG. 1.

Referring to FIGS. 1-5, a concealed connector for connecting a first structural component 12 to a second structural component 14 is generally shown at reference numeral 10. When connected to the first and second structural components 12, 14, the concealed connector 10 is substantially hidden from view by the first and second structural components. Such a hidden connection may be desirable in certain building applications, such as when the connection between the first and second structural components will be visible to building occupants once the building is completed. The concealed connector 10 may be used to connect generally any two structural components 12, 14 together, such as joists, beams, columns, trusses, headers, foundations, etc. Typically, the first structural component will be made of wood or a wood composite (e.g., solid sawn, structural composite lumber, or multi-ply wood framing). The second structural component can be made of generally any material (e.g., wood, wood composite, metal, concrete, composite materials, etc.). In the illustrated embodiment and without limitation, the concealed connector 10 is a hanger used to mount the first structural component 12, which is a wood joist, to the second structural component 14, which is a header. The type and size of the structural components 12, 14 may vary from the illustrated embodiment without departing from the scope of the disclosure, as the connector 10 is readily applicable to other structural configurations (e.g. a larger or smaller structural components). The header 14 includes a front face 18 and a top surface 20. The joist 12 is mounted on the header 14 adjacent the front face 18 by the connector 10. Specifically, the concealed connector 10 connects an end 16 of the joist 12 to the front face 18 of the header 14. Other configurations of the structural connection between the first and second structural components 12, 14 are within the scope of the present disclosure.

Figure 5:
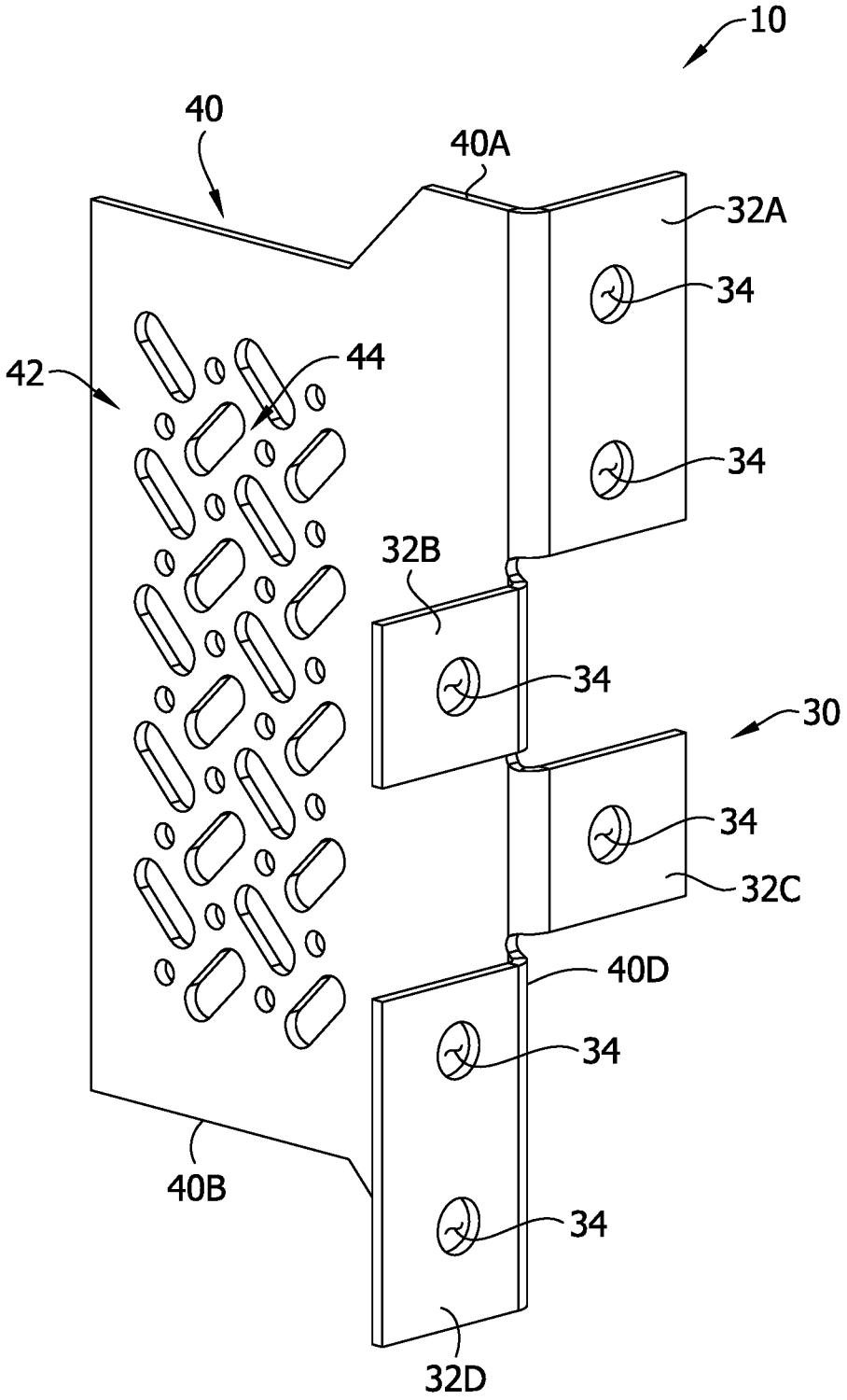
FIG. 5 is a rear perspective thereof.

The concealed connector 10 includes a connection portion 30 configured to attach to the header 14. In the illustrated embodiment, the connection portion 30 is configured to be attached to the front face 18 of the header 14. The connection portion 30 defines a connection plane that extends generally parallel to the front face 18 of the header 14 when the connector 10 is installed or mounted on the header. In the illustrated embodiment, the connection portion 10 includes a plurality of connection flanges 32A-D (FIG. 5). The connection flanges 32A-D are generally planar and are generally co-planar with one another (and the connection plane). The connection flanges 32A-D may each include one or more fastener openings 34 sized and shaped to permit a fastener 24 to be inserted there-through to connect the connection portion 30 to the header 14. When the connection portion 30 is connected to the header 14, the connection flanges 32A-D each have a major surface extending generally parallel to the front face 18 for flush engagement with the front face. Other configurations of the connection portion 30 are within the scope of the present disclosure. For example, the connection portion 30 may include one or more top flanges (not shown) configured to overlie, engage and be connected to the top surface 20 of the header 14.

The concealed connector 10 includes a connection plate 40 configured to attach to the joist 12. The connection plate 40 is sized and shaped to extend into a slot 22 in the joist 12, and to be contained substantially entirely within the joist so that the connection plate is concealed by the joist. The slot 22 may be formed in the joist by using a conventional ⅛ inch (3.2 mm) circular saw blade. Accordingly, preferably the connection plate 40 has a thickness equal to or less than ⅛ inch (3.2 mm). When attached to the joist 12, the connection plate 40 generally extends along or parallel to the longitudinal axis of the joist. The connection portion 30 and connection plate 40 may be directly or indirectly coupled together. For example, in the illustrated embodiment, the connection portion 30 extends from and is contiguous with the connection plate 40. The connection plate 40 and connection flanges 32A-D are generally perpendicular to one another. In the illustrated embodiment, the connection flanges 32A-D extend in generally opposite directions from a rear edge margin 40D of the connection plate 40 (FIG. 5). The first and third connection flanges 32A, 32C extend from the connection plate 40 in a first (e.g., left) direction and the second and fourth connection flanges 32B, 32D extend from the connection plate in a second (e.g., right) direction. Preferably, the end face of the joist at end 16 is formed with a recess that receives the thickness of the flanges 32A-32D. Thus, when the joist is connected to the header 14, the flanges are also concealed by the joist. In the illustrated embodiment, the connection plate 40 is generally perpendicular to the connection plane such that the connector 10 support the joist 12 at a generally perpendicular or orthogonal angle relative to the header 14. In other embodiments, the connection plate 40 may be disposed at other angles relative to the connection plane so that the connector 10 can support the joist 12 at other angles (e.g., 45 degrees) relative to the header 14.

Figure 6:
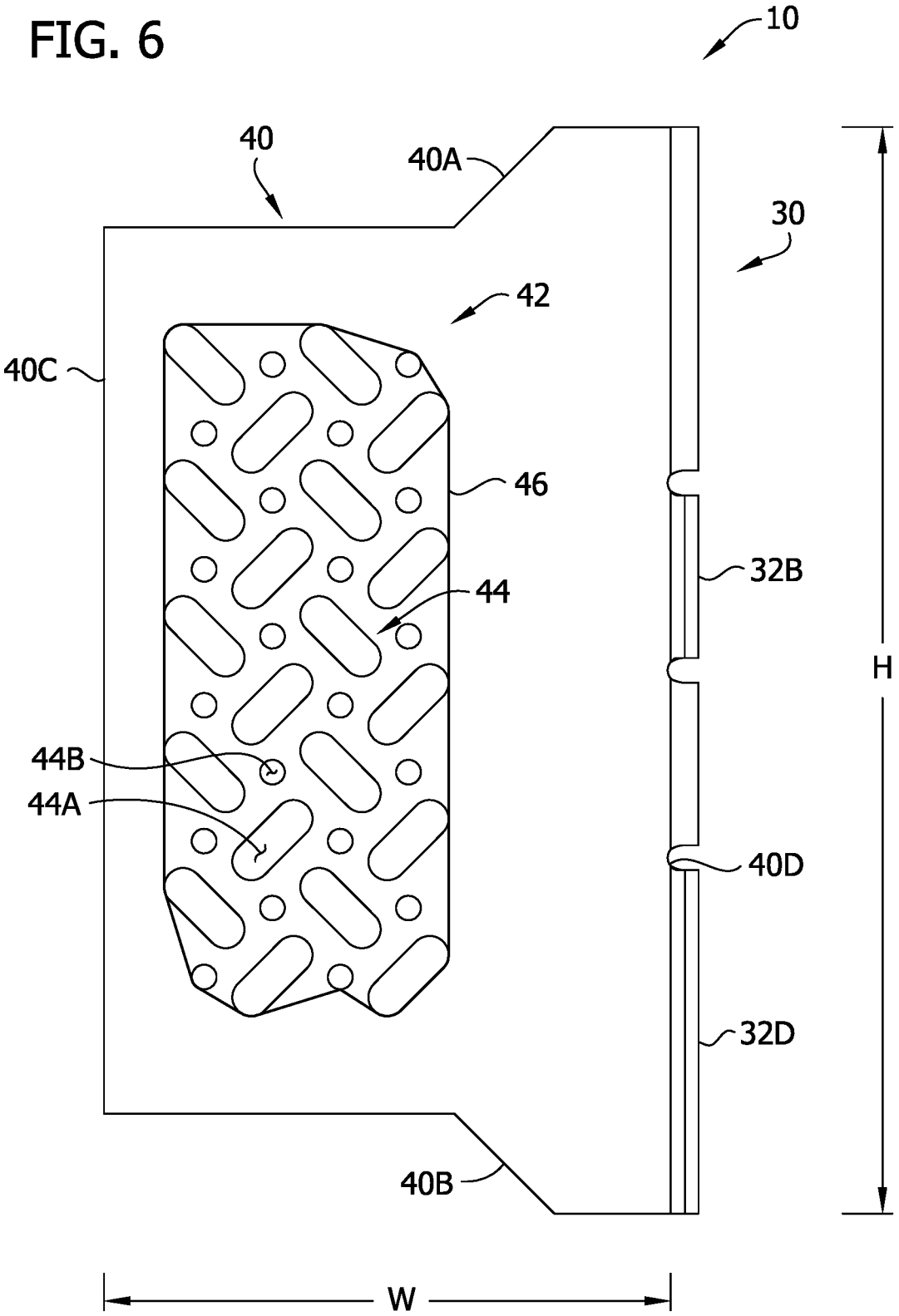
FIG. 6 is a right side elevation thereof.
Figure 7:
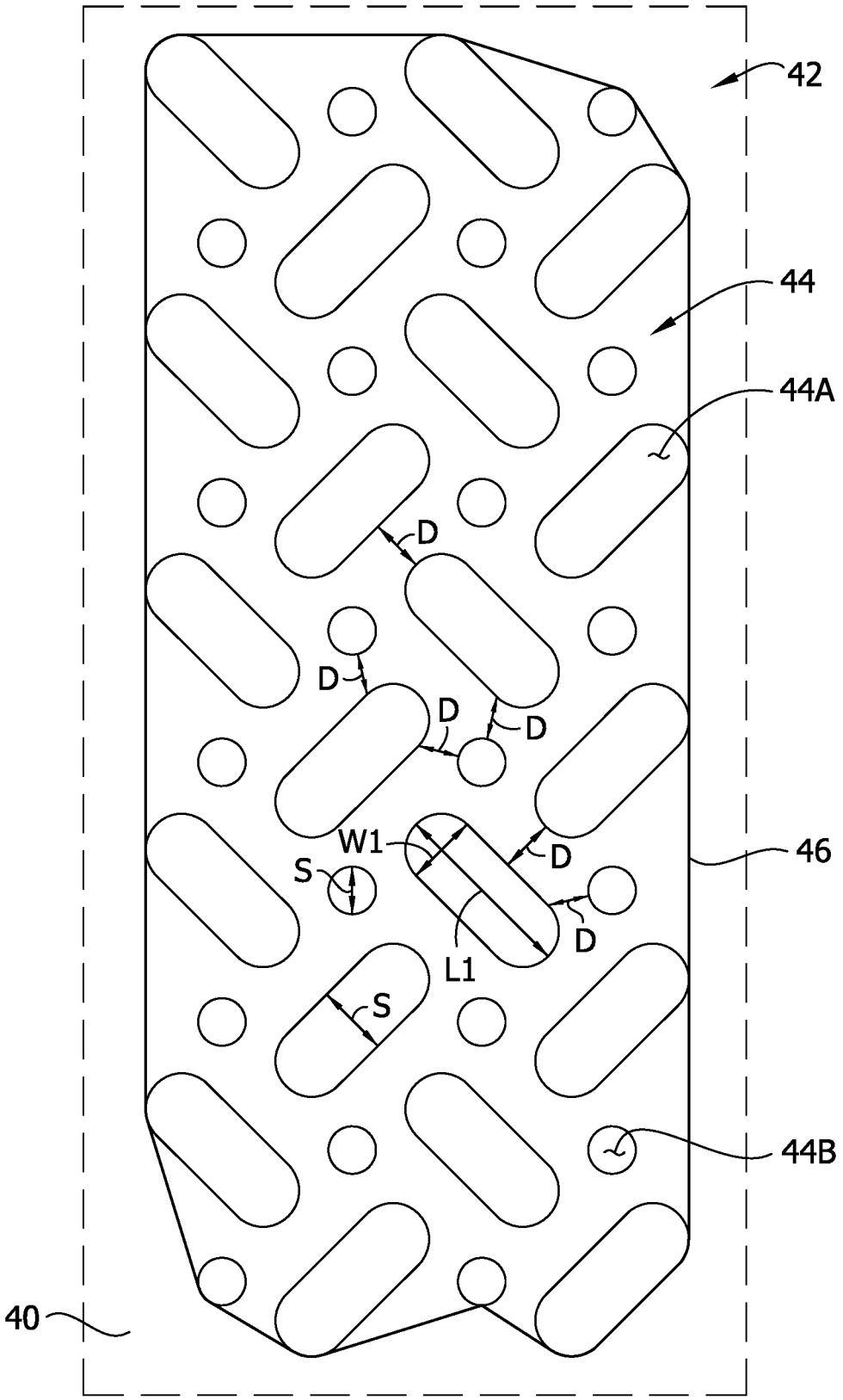
FIG. 7 is an enlarged, schematic right side elevation of a connection plate of the concealed connector.
Figure 8:
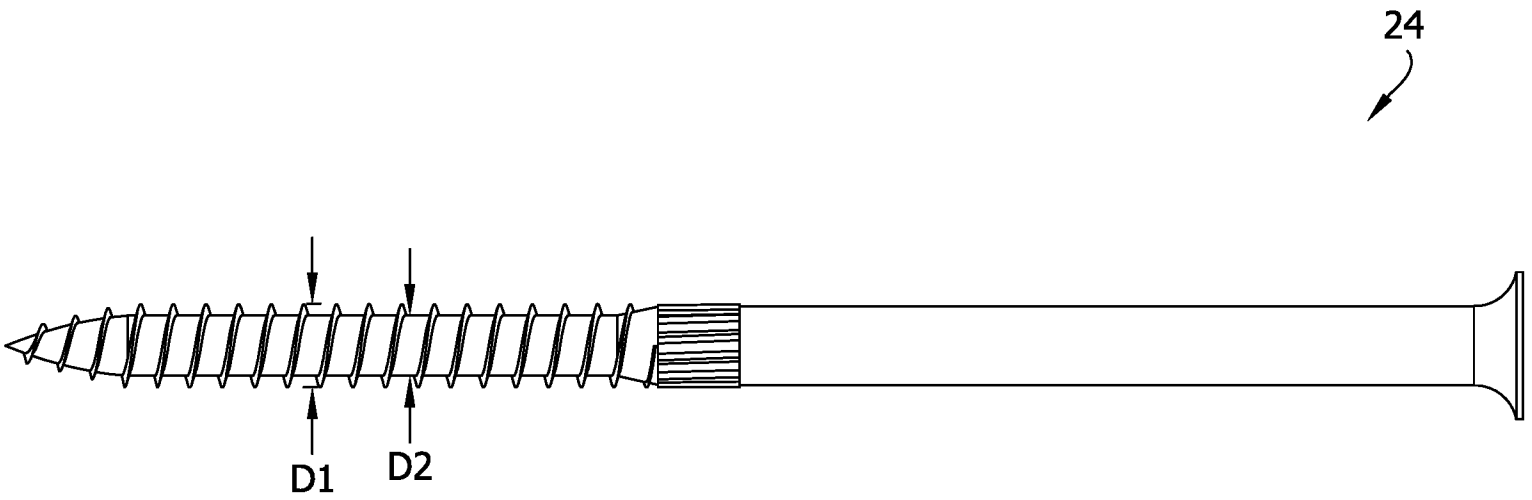
FIG. 8 is a side elevation of an exemplary fastener used to connect the connection plate of the concealed connector to the first structural component.

Referring to FIGS. 3-7, the connection plate 40 includes a connection or perforated region 42. The perforated region 42 is configured to be penetrated by at least one fastener 24 to attach the connection plate 40 to the joist 12. The perforated region 42 is configured to be deformed by the one or more fasteners 24 used to attach the connector 10 to the joist 12 to permit these fasteners to penetrate the perforated region of the connection plate 40. By penetrating the connection plate 40 in the perforated region 42, the fasteners 24 extend through the connection plate to secure the connection plate to the joist 12 (FIG. 1). The fastener 24 is sized to connect the joist 12 to the connection plate 40. The fastener 24 has a length sufficient to enable the fastener to extend through one side of the joist 12, through connection plate 40 (e.g., slot 22), and into the other side of the joist. In the exemplary embodiment, the fastener 24 is a one quarter inch (6 mm) screw but other sizes and types of fasteners (e.g., bolts) are within the scope of the present disclosure. FIG. 8 illustrates an exemplary screw 24 that can be used to secure the connector 10 to the joist and header 12, 14. The screw 24 may be a conventional wood screw. Preferably, the perforated region is set in from the end 16 of the joist 12 by about five diameters of the fastener used to the connection, and is at least about 1.25 inches (32 mm) in the illustrated embodiment.

The connection plate 40 is generally planar and is made of a suitable material, such as steel. The connection plate 40 has opposite upper and lower edge margins 40A, 40B and opposite front and rear edge margins 40C, 40D. The connection plate 40 has a height H and a width W (FIG. 6). The height H extends between the upper and lower edge margins 40A, 40B. The width W extends between the front and rear edge margins 40C, 40D. In one embodiment, the height H of the connection plate 40 is about 4.5 inches (11.5 cm) and the width W of the connection plate is about 3 inches (7.6 cm). These dimensions of the concealed connector generally correspond to a joist with a height of 7.5 inches (19 cm). Preferably, the width W of the connection plate 40 is equal to or less than 3 inches (7.6 cm) so that the slot 22 the connection plate is inserted into can have a depth (parallel to the longitudinal axis of the joist 12) equal or less than 3 inches. The depth of such a slot 22 can be readily cut by a conventional 8¼ inch (21 cm) circular saw blade that is widely used in construction. Other dimensions of the connector 10 are within the scope of the present disclosure. The dimension of the connector 10 can be adjusted to correspond to structural components of other shapes and sizes.

The connection plate 40 has a plurality of openings 44. The openings 44 collectively define the perforated region 42 of the connection plate 40. The perforated region 42 has a perimeter 46. The perimeter 46 bounds and encloses the perforated region 42. The perimeter 46 is comprised of generally straight line segments extending between the outermost points of generally adjacent outermost openings 44 of the connection plate 40 (FIG. 7). In some places, the perimeter 46 follows the curvature of a portion of one of the openings 44. As used herein, the term outermost refers to a location that is away from or opposite to a center of the perforated region 42 (FIG. 7). In the illustrated embodiment, the perimeter 46 has a generally rectangular shape. Other shapes (e.g., irregular, circular, square, etc.) of the perimeter 46 of the perforated region are within the scope of the present disclosure.

The amount of perforation in the perforated region can be expressed as a void percentage. The void percentage is a function of the total open area of the plurality of openings 44 divided by total surface area of the perforated region 42. The total open area is the sum of the areas of all the openings 44. The total surface area of the perforated region 42 is the area bounded by the perimeter 46. Accordingly, the total surface area includes the total open area. The void percentage corresponds to the ease at which the screws 24 can deform the perforated region 42 (e.g., the portions of the connection plate 40 in the perforated region). The larger the void percentage the easier for a screw 24 to deform the perforated region 42 and thereby become mechanically engaged with the connection plate 40. However, the larger the void percentage the less load (e.g., shear load) the perforated region 42, and therefore the connection plate 40, can carry. Preferably, the void percentage is within an inclusive range of about 10% to about 70%, or more preferably within an inclusive range of about 20% to about 50%, or more preferably within an inclusive range of about 30% to about 50%, or more preferably within an inclusive range of about 35% to about 45%, or more preferably about 40%.

Referring to FIG. 7, each opening 44 has a dimension S (e.g., a minimum dimension) less than an outer diameter of the at least one screw 24. The outer diameter can be generally any diameter of the screw 24, such as a major diameter D1, a minor or root diameter D2, a pitch diameter, or a shaft diameter (see, FIG. 8). Preferably, the dimension S of the opening 44 is equal to or less than the minor diameter D2 of the at least one screw 24. This ensures that even if the screw 24 extends through a center of one of the openings 44, the threads (broadly, a portion) of the screw will still engage and deform at least a part of the portion of the connection plate 40 defining the opening, forming a positive connection between the screw and connection plate. In addition, preferably the dimension S of the opening 44 is equal to or greater than about half the minor diameter D2 of the screw 24. This increases the likelihood that the tip of the screw 24 will intersect one of the openings 44 when the screw is driven into the connection plate 40. The perforated region 42 of the connection plate 40 will more easily deform if the tip of the screw 24 intersects one of the openings 44 than if the tip of the screw contacts a portion of the connection plate between the openings. Moreover, this also provides sufficient space in each opening 44 to allow a portion of the connection plate 40 contacted by the screw 24 to deform into an opening, as needed. The dimension S of the opening 44 can be any typical dimension such as a height, a width, a length, a diameter, etc.

In one embodiment (not shown) at least the openings 44 in one subregion of the perforated region 42 are configured so that no matter where the screw 24 engages the connection plate 40 within that subregion, the connection plate is engaged and deformed by the screw to connect the screw with the connection plate. For example, it is possible that preformed openings 44 in another part of the perforated region 42 could be sized, shaped and arranged so that engagement of the screw 24 in certain locations would not permit deformation. In that event, a template (not shown) might be used in those other perforated subregions so that the screw 24 or other fastener could pass through the openings 44 without substantial engagement with the connection plate 40. In other words, in one embodiment, the perforated region 42 may include one or more subregions where the configuration of the openings 44 permits the screw 24 deforms the connection plate 40 and one or more subregions where the configurations of the openings does not permit the screw to deform the connection plate. For example, the connection plate 40 may include conventional preformed openings sized and shaped to receive a fastener in the same manner as conventional connectors with preset openings and openings 44 described herein configured to permit a screw to deform the connection plate. However, in the illustrated embodiment, the openings 44 are configured so that no matter where the screw 24 engages the connection plate 40 in the perforated region 42, deformation of the connection plate is assured by the configuration of the openings. As used here, "configuration" includes not only the size and shape of the openings, but also their arrangement relative to each other.

In the illustrated embodiment, the connection plate 40 includes two types of openings 44A, 44B. The first and second types of openings 44A, 44B may have different sizes and/or shapes. The first type of opening 44A has a generally elongate shape and the second type of opening 44B has a generally circular shape. Both types of openings 44A, 44B have at least one dimension S that is less than the outer diameter of the screw 24 and, more preferably, that is equal to or less than the minor diameter D2 of the screw 24. Likewise, the dimension S of the first and second types of openings is preferably equal to or greater than about half the minor diameter of the screw 24. The elongate shape of the first type of opening 44A has a length L1 and a width W1 (FIG. 7). The width W1 of the first type of opening is preferably the same as (e.g., equal to) the dimension S for the first type of opening. The length L1 of the first type of opening 44A is preferably greater than or equal to about half the minor diameter D2 of the screw 24, and more preferably, greater than or equal to the minor diameter of the screw, and more preferably, greater than or equal to the outer diameter of the screw, and more preferably greater than the outer diameter of the screw. In one embodiment, the length L1 of the first type of opening 44A may be a may be a multiple (e.g., 2×, 3×, 4×, 5×, 6×, etc.) of the outer diameter of the screw 24. For example, in one embodiment, the length L1 of the first type of opening is about 4× (i.e., 4 times) the minor diameter D2 of the screw 24. The length L1 of the first type of opening 44A may be within the inclusive range of greater than about the minor diameter D2 of the screw 24 and less than about 4× the minor diameter of the screw. In the illustrated embodiment, the elongate shape of the first type of opening 44A is oriented at an angle to the height H and the width W (e.g., vertical and horizontal) of the connection plate 40. As shown, the angle is about 45 degrees relative to the height H and the width W of the connection plate 40. However, other angles are within the scope of the present disclosure. The circular shape of the second type of opening 44B has a diameter that is the same as the dimension S for the second type of opening. In other embodiments, the connection plate 40 may include only one type of opening or more than two types (e.g., three, four, etc.) types of openings.

The first and second types of openings 44A, 44B are arranged in a grid-like pattern (e.g., a vertical/horizontal or column row grid, an angled grid, etc.). In the illustrated embodiment, the first and second types of openings 44A, 44B are arranged in an alternating pattern. As shown in FIG. 7, as the openings 44A, 44B extend horizontally (e.g., in a direction generally parallel to the width W of the connection plate 40), the openings 44 alternate between the first type of opening and the second type of opening (e.g., first, second, first, second, first, etc.). Likewise, as the openings 44A, 44B extend vertically (e.g., in a direction generally parallel to the height H of the connection plate 40), the openings 44 alternate between the first type of opening and the second type of opening (e.g., first, second, first, second, first etc.). FIG. 7 shows one possible arrangement of the openings 44, however other arrangements are within the scope of the present disclosure. For example, in one embodiment, the openings 44 can have a generally random arrangement, such as an arrangement similar to dimples on a golf ball.

Referring to FIG. 7, the openings 44 are shaped an arranged in the perforated region 42 to permit the perforated region of the connection plate 40 (e.g., the portions of the connection plate between the openings) to be deformed by the screws 24 inserted through the perforated region. Specifically, the openings 44 are shaped and arranged so that a screw 24 passing through any location within the perforated region 42 intersects and deforms the connection plate 40. The openings 44 enable the portions of the connection plate 40 between the openings 44 to deform around the one or more screws 24. Thus, the openings 44 are strategically placed and dimensioned to weaken the material of the connection plate 40 and permit the material to be easily deformed by each screw 24. In one embodiment, a distance D (e.g., a minimum distance) between adjacent openings 44 of the plurality of openings is less than an outer diameter of the at least one screw 24. Preferably, the distance D between adjacent openings 44 of the plurality of openings is equal to or less than the minor diameter D2 of the at least one screw 24. This distance sufficiently weakens the perforated region of the connection plate 40 so that the portion of the connection plate in the perforated region will deform about the screw 24 as the screw is driven into the connection plate. In addition, preferably the distance D between adjacent openings 44 of the plurality of openings is equal to or greater than half the minor diameter D2 of the at least one screw 24. This ensures that the portion of the connection plate 40 engaging the screw 24 has sufficient strength to transfer the load imparted by the joist 12 via the screw.

The perforated region 42 is configured to be deformed by the screws 24 with minimal thread-jacking of the screws. Thread-jacking occurs when a screw 24 rotates in place without moving longitudinally through the host material (e.g., wood) the screw is in. As the screw 24 continues to rotate without any longitudinal movement, the threads of the screw move out of the helical groove the threads formed when the screw was driven into the host material. This results in the threads of the screw 24 damaging the host material, with more damage occurring during each additional revolution of the screw. The rotation of the screw 24 causes the threads to bore a hole in the host material, which can become quite large (e.g., greater than the major diameter D1 (FIG. 8) of the screw) if the thread jacking continues. Because of this hole, the threads of the screw 24 are no longer able to grip the host material and the strength of the connection between the screw and the host material in the area where the thread-jacking occurred is substantially reduced. Moreover, thread-jacking may cause the joist 12 to split apart, destroying the first structural member and requiring it to be replaced. One example of where thread-jacking occurs is when the tip of a screw being driven through a wooden member (e.g., a wood beam) contacts a solid metal plate (e.g., a ⅛ inch (3.2 mm) steel plate) in the wooden member, thereby inhibiting the screw from longitudinally moving further into wooden member (e.g., host material). Depending on the type of screw 24 and the material of the metal plate, the screw may not be even able to penetrate the solid steel plate. A worker would have to use a more expensive self-drilling screw (compared to a conventional wood screw) in order to penetrate the steel plate. While a self-drilling screw would eventually be able to penetrate the steel plate, it would still take many revolutions of the screw to drill through the steel plate, causing a significant amount of thread-jacking.

The openings 44 of the perforated region 42 are sized, shaped and arranged to enable screws 24 to deform the connection plate 40 and minimize any thread-jacking that may occur in the host material (e.g., joist C1). In particular, the openings 44 enable the screws 24 to move (e.g., deform) the portions of the connection plate 40 between the openings out of the way. By moving a portion of the connection plate 40 out of the way, the screw 24 is able to move longitudinally through the host material with a minimal amount of thread jacking force and without damaging the host material. This would not be possible if the screw was drilling through a connection plate made of a solid piece of material (e.g., metal). This also allows the threads of the screw 24 to still grip the host material, forming a stronger connection between the screw and the host material than if a larger amount of thread-jacking force or damage to the host material had occurred. In one embodiment, perfect alignment with the perforated region 42 may permit the screw 24 to penetrate the connection plate 40 with no thread jacking force present with is not possible if the connection plate was solid (i.e., did not have any openings 44). Of course, the exact amount of thread jacking force needed to penetrate the connection plate 40 depends on numerous factors, such as but not limited to the design of the screw 24, the thickness of the connection plate, the strength of the host material and the external force being applied to push the screw into and through the connection plate.

Other configurations (e.g., number, size, shape, arrangement, pattern) of the openings 44 are within the scope of the present disclosure.

The connector 10 may be a single, unitary piece of material. For example, the connector 10 can stamped from a piece of sheet metal, such as 11-14 gauge steel, although other suitable gauges and materials are within the scope of the present disclosure. Preferably, the connector 10 is made from 11 gauge steel, having a thickness of 0.1196 in (3 mm), which is the minimum gauge size of steel that can be inserted into a ⅛ inch (3.2 mm) width slot 22 cut by a single pass of a circular saw blade. The use of lower gauge sizes of steel (i.e., thicker sheets of steel) for the connector 10 are possible, but less desirable because it would require multiple passes by a conventional ⅛ inch thick saw blade to form the slot 22 in the joist 12, increasing the construction time needed to install the connector. In other embodiments, the connector 10 may be assembled from multiple pieces joined and fixed together, such as by welding.

In one embodiment, the connector 10 is positioned on the header 14 so that the connection flanges 32A-D engage the front face 18 of the header. Once the connector 10 is placed in the desired position on the header 14, screws 24 are driven through the fastener openings 34 in the connection flanges 32A-D into the front face of the header 14, thereby securing the connector to the header. The slot 22 is cut in the end of the joist 12. The slot 22 is cut to have a width larger than the thickness of the connection plate 40. As mentioned above, preferably, the connection plate 40 has a thickness less than ⅛ inch (3.2 mm) so that the slot 22 can be formed with a single pass of a conventional ⅛ inch thick circular saw blade. The joist 12 is then positioned relative to the connector 10 such that the connection plate 40 is received in the slot 22. The screws 24 are then driven into the joist 12 anywhere within the perforated region 42 to secure the connector 10 to the joist. The first screw 24 is generally aligned with the perforated region 42 of the connection plate 40 and driven into the joist 12, through the perforated region. As the first screw 24 moves through the perforated region 42, the screw will engage and deform the perforated region of the connection plate 40. In one embodiment, the connector plate 40 and joist 12 may move slightly (e.g., less than about the minor diameter D2 of the screw 24) relative to one another when the first screw is driven into the joist and into the connector 10. This occurs because it is easier for the first screw 24 to penetrate the connection plate 40 by moving substantially entirely through one of the openings 44 to minimize the amount of resistance (e.g., deformation) the first screw experiences when moving through the perforated region 42. If the first screw 24 extends through one of the first type of openings 44A, the angled orientation of the elongate shape of the first type of opening 44A directs any such movement in both the heightwise and widthwise directions (relative to the connection plate 40). This minimizes the overall movement of the screw 24 and by extension the joist 12 in the heightwise and widthwise directions, making any such heightwise and widthwise movement that may occur negligible.

Subsequent screws 24 are then aligned with the perforated region 42 and driven into the joist 12 and through the connection plate 40. The first screw 24 inhibits any further movement between the connection plate 40 and the joist 12 so that the subsequent screws cannot move the connection plate and joist 12 relative to one another. Instead, the subsequent screws 24 will deform the perforated region 42 of the connection plate 40 as needed in order to penetrate and extend through the connection plate. Any number of screws 24 can be used to secure the connection plate 40 to the joist 12. For example, in one embodiment, five screws 24 are used to secure the connection plate 40 and joist 12 together. The concealed connector 10 thereby mounts the joist 12 on the header 14 once the connector is secured to both the joist and header 12, 14.

The perforated region 42 is large enough to permit the plurality of screws 24 to be easily (and roughly) aligned with the perforated region when the screws are driven into the joist 12 and through the connection plate 40. This eliminates the need to painstakingly form and align openings in the joist 12 that align with preset openings in a connection plate of conventional concealed connectors. The size of the perforated region 42 can be expressed as a percentage of the overall size of the connection plate 40. This percentage is a function of the total surface area of the perforated region 42 divided by the total surface area of the connection plate 40. The total surface of the connection plate 40 is the area bounded by the edge margins 40A-D of the connection plate. The larger the percentage, the larger the perforated region 42 and the easier it is to position a screw 24 so that it will intersect the perforated region. However, the larger the percentage, the less load (e.g., shear load) that can be carried by the connection plate 40. Preferably, the percentage of the size of the perforated region 42 relative to the connection plate 40 is within an inclusive range of about 25% to about 75%, or more preferably within an inclusive range of about 30% to about 60%, or more preferably within an inclusive range of about 35% to about 50%, or more preferably about 40%. The perforated region 42 may be appropriately spaced from the edge margins 40A-D of the connection plate 40 to comply with National Design Specification for Wood Construction requirements and recommendations.

A perforated region 42 as described herein permits a conventional wood screw 24 to penetrate the connection plate 40. Conventional wood screws could not be used with conventional solid plate concealed connectors made of harder materials like steel because conventional wood screws do not have the ability to penetrate a connection plate made of these harder materials. Even if a conventional wood screw 24 was able to penetrate a solid steel plate, it would only be able to do so after a significant amount of undesirable thread-jacking had occurred. Accordingly, conventional solid plate concealed connectors are made of softer materials (e.g., aluminum), in order to permit fasteners such as conventional wood screws to penetrate it, unlike the connector 10 of the present disclosure.

Moreover, because conventional solid plate concealed connectors are made of softer materials, their connection plates must be thicker and larger in order to have the same load bearing capacity as connection plates made of harder (e.g., stronger) materials. Thus, the slots the conventional solid plate concealed connectors extend into must be wider and deeper, requiring multiple passes of a circular saw blade. Since the connector 10 of the present disclosure can be made from harder materials (e.g., steel), the connector plate 40 can be thinner to permit the slot 22 to be formed with a single pass of a standard circular saw blade while still having the same load capacity as a corresponding conventional solid plate concealed connector. Likewise, because the connection plate 40 of the present disclosure can be formed of stronger materials, such as steel, and still allow conventional wood screws 24 to penetrate it, the connector 10 of the present disclosure is stronger (e.g., has a greater load bearing capacity) than comparable conventional solid plate concealed connectors made of softer materials and having the same connector plate thickness and size as connector plate 40.

Figure 9:
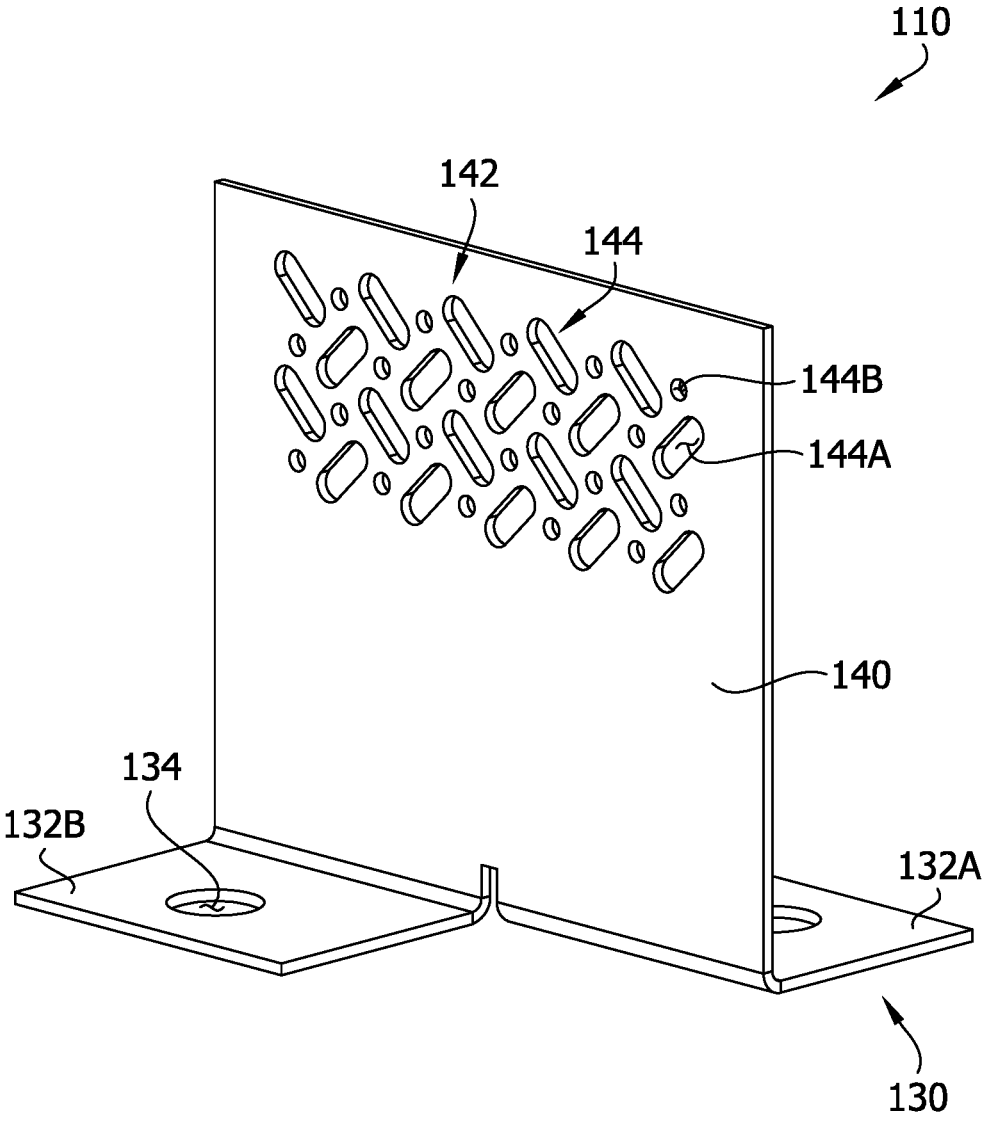
FIG. 9 is a perspective of another embodiment of a concealed connector according to the present disclosure.
Figure 10:
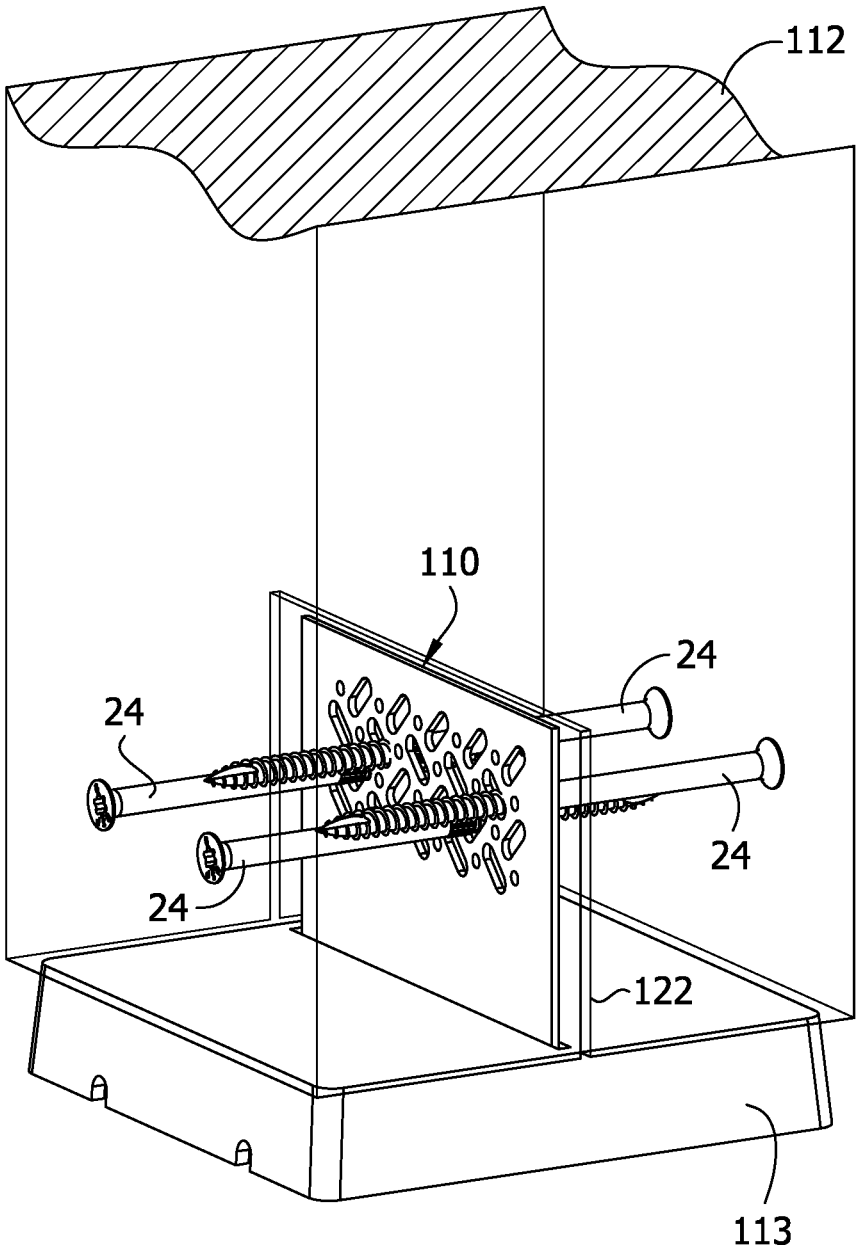
FIG. 10 is a perspective of the concealed connector of FIG. 9 connecting a first structural component to a second structural component.

Referring to FIGS. 9 and 10, another embodiment of a concealed connector is generally shown at reference numeral 110. Like connector 10, concealed connector 110 connects a first structural component 112 to a second structural component (not shown). In this embodiment, the concealed connector 110 is a post base connector used to attach the first structural component, which is a post or column, to the second structural component, which may be a concrete foundation. In the illustrated embodiment, the connector 110 extends upward through a post standoff 113 which is positioned between the bottom of the post 112 and the concrete foundation. Concealed connector 110 is analogous to concealed connector 10 and, thus, for ease of comprehension, where similar or analogous parts are used, reference numerals "100" units higher are employed. The main difference between the connectors 10, 110 is that connector 10 is configured as a hanger and connector 110 is configured as a post base connector. Otherwise, the connectors 10, 110 are generally the same. As is apparent, concealed connector 110 includes many of the same elements as and functions in a similar manner to concealed connector 10. Accordingly, where appropriate, the description above with respect to connector 10 also applies to connector 110 and, thus, a detailed description of connection 110 is omitted herein.

Figure 11:
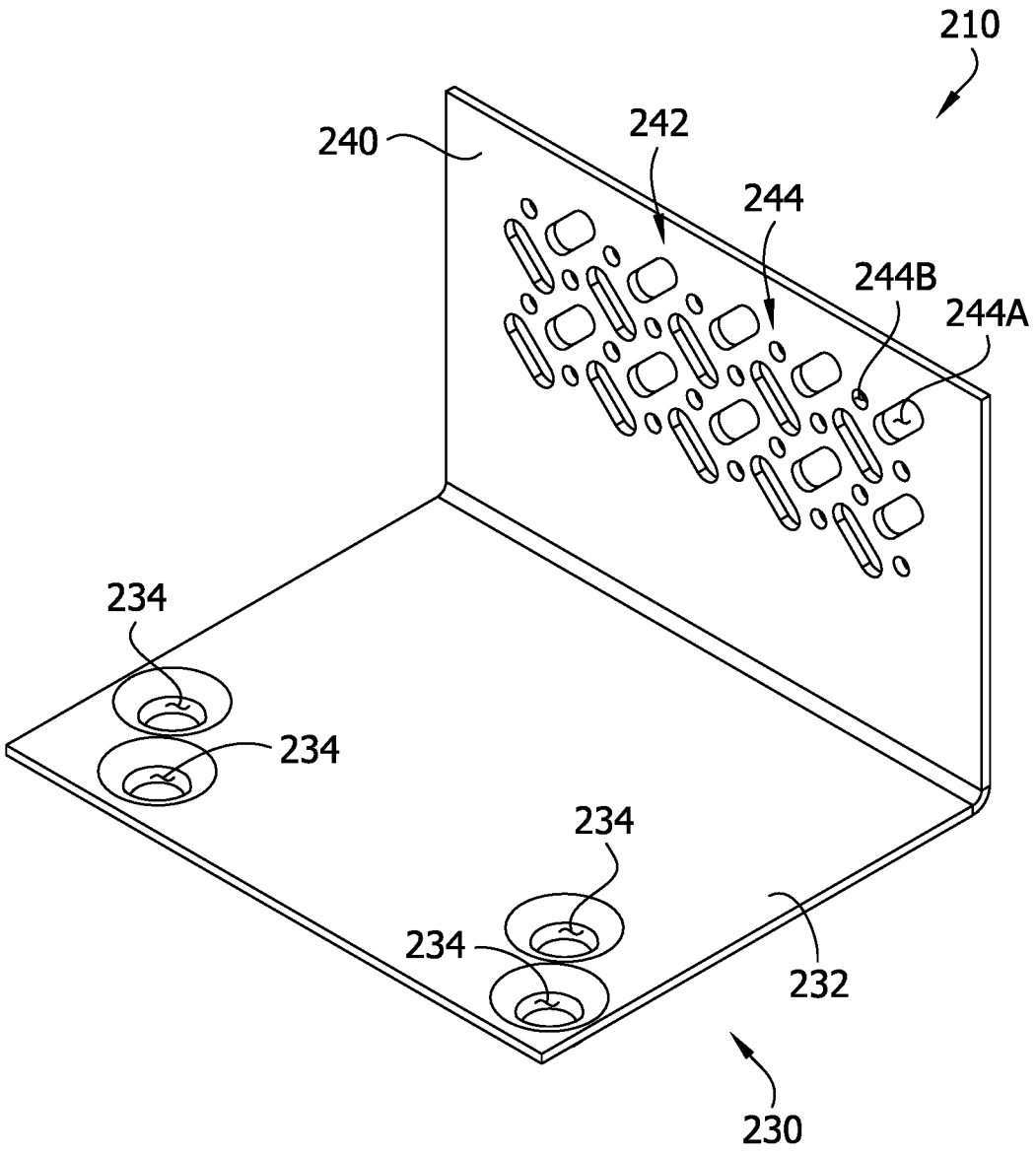
FIG. 11 is a perspective of another embodiment of a concealed connector according to the present disclosure.

Referring to FIG. 11, another embodiment of a concealed connector is generally shown at reference numeral 210. Like connector 10, concealed connector 210 connects a first structural component (not shown) to a second structural component (not shown). In this embodiment, the concealed connector 210 is an angled (e.g., right-angle) connector, which can be used in a variety of different applications. For example, connector 210 can be used in cross laminated timber (CLT) construction, such as for connecting a CLT wall panel to a CLT floor. Concealed connector 210 is analogous to concealed connector 10 and, thus, for ease of comprehension, where similar or analogous parts are used, reference numerals "200" units higher are employed. The main difference between the connectors 10, 210 is that connector 10 is configured as a hanger and connector 210 is configured as an angled connector. Otherwise, the connectors 10, 210 are generally the same. As is apparent, concealed connector 210 includes many of the same elements as and functions in a similar manner to concealed connector 10. Accordingly, where appropriate, the description above with respect to connector 10 also applies to connector 210 and, thus, a detailed description of connection 210 is omitted herein.

Other configurations of the concealed connector 10, 110, 210 for other types of connections are within the scope of the present disclosure.

Having described the disclosure in detail, it will be apparent that modifications and variations are possible without departing from the scope of the disclosure defined in the appended claims. For example, where specific dimensions are given, it will be understood that they are exemplary only and other dimensions are possible.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products without departing from the scope of the disclosure, it is intended that all matter contained in the above description and shown in the accompanying drawings shall be interpreted as illustrative and not in a limiting sense.

What is claimed is:

1. A concealed connector for connecting a first structural component to a second structural component, the concealed connector comprising:

a connection portion configured to attach to the second structural component; and a connection plate configured to attach to the first structural component, the connection plate being attached to the connection portion and arranged to extend into a slot in the first structural component, the connection plate having a plurality of first openings of a first type of opening and a plurality of second openings of a second type of opening different from the first type of opening, the first and second openings disposed in an alternating arrangement.

2. The concealed connector of claim 1, wherein the first and second types of openings have different shapes.

3. The concealed connector of claim 2, wherein the first and second types of openings have different sizes.

4. The concealed connector of claim 3, wherein the first type of opening has a circular shape.

5. The concealed connector of claim 4, wherein the second type of opening has an elongate shape.

6. The concealed connector of claim 5, wherein the plurality of the first opening and the plurality of the second openings are arranged in a grid-like pattern, the grid-like pattern having an x-axis and a y-axis, and wherein the elongate shape of the second type of opening is oriented at a skew angle to the x-axis and the y-axis.

7. The concealed connector of claim 1, wherein the first and second openings are disposed to form multiple rows and multiple columns.

8. The concealed connector of claim 1 wherein the first and second openings are arranged in a grid-like pattern.

9. The concealed connector of claim 1, wherein the first and second types of openings have different sizes.

10. The concealed connector of claim 1, wherein the first type of opening has a circular shape.

11. The concealed connector of claim 1, wherein the second type of opening has an elongate shape.

12. The concealed connector of claim 5, wherein the plurality of the first opening and the plurality of the second openings are arranged in a grid-like pattern, the grid-like pattern having an x-axis and a y-axis, and wherein the elongate shape of the second type of opening is oriented at a skew angle to the x-axis and the y-axis.

13. The concealed connector of claim 1, wherein the alternating arrangement of the first and second openings includes a first single-file line comprising a first opening of the plurality of first openings followed immediately by a second opening of the plurality of second openings followed immediately by another first opening of the plurality of first openings.

14. The concealed connector of claim 13, wherein the first single-file line further comprises another second opening of the plurality of second openings immediately following said another first opening.

15. The concealed connector of claim 14, wherein the connection plate has a height and a width, the first single-file line being oriented parallel to the height of the connection plate.

16. The concealed connector of claim 14, wherein the connection plate has a height and a width, the first single-file line being oriented parallel to the width of the connection plate.

17. The concealed connector of claim 13, wherein the alternating arrangement of the first and second openings includes a second single-file line parallel to the first single file line and comprising a second opening of the plurality of second openings followed immediately by a first opening of the plurality of first openings followed immediately by another second opening of the plurality of second openings.

18. The concealed connector of claim 1, wherein the plurality of the first opening and the plurality of the second openings are arranged in a grid-like pattern having a plurality of rows and a plurality of columns, the first and second openings disposed in an alternating arrangement in each row and each column of the gird-like pattern.

19. The concealed connector of claim 1, wherein the connection plate has a lower edge extending from the connection portion to an end of the of the connection plate, the lower edge being exposed from the connection portion to the end of the connection plate.

20. The concealed connector of claim 1, wherein the connection portion and the connection plate are a single, unitary piece of sheet metal.

* * * * *